United States Patent [19]

Peveto et al.

[11] 4,171,734

[45] Oct. 23, 1979

[54] EXPONENTIAL HORN SPEAKER

[75] Inventors: Robert S. Peveto; Phillip R. Clements, both of Dallas, Tex.

[73] Assignee: Beta Sound, Incorporated, Dallas, Tex.

[21] Appl. No.: 850,422

[22] Filed: Nov. 10, 1977

[51] Int. Cl.[2] ..... G10K 11/00

[52] U.S. Cl. ..... 181/192; 181/195

[58] Field of Search ..... 181/192, 195, 197, 159

[56] References Cited

U.S. PATENT DOCUMENTS

| | | | |
|---|---|---|---|
| 1,795,936 | 3/1931 | DeForest | 181/192 |
| 1,992,268 | 2/1935 | Wente | 181/187 |
| 2,001,089 | 5/1935 | Blattner | 181/192 |
| 2,310,243 | 2/1943 | Klipsch | 181/156 |
| 2,338,262 | 1/1944 | Salmon | 181/192 |
| 2,373,692 | 4/1945 | Klipsch | 181/152 |
| 2,537,141 | 1/1951 | Klipsch | 181/188 |
| 2,690,231 | 9/1954 | Levy et al. | 181/192 |
| 2,731,101 | 1/1956 | Klipsch | 181/148 |
| 2,897,292 | 7/1959 | Van Den Bosch | 181/187 |
| 3,930,561 | 1/1976 | Klayman | 181/192 |
| 3,935,925 | 2/1976 | Koiwa et al. | 181/192 |
| 3,972,385 | 8/1976 | Hino et al. | 181/192 |

FOREIGN PATENT DOCUMENTS

| | | | |
|---|---|---|---|
| 1085680 | 7/1954 | France | 181/192 |

*Primary Examiner*—Stephen J. Tomsky

[57] ABSTRACT

An exponential horn for use in a speaker is provided and includes a horn having a mouth, a throat and horn wall sections connecting the horn mouth and the horn throat. The horn wall sections define a horn whose cross sectional area progressively increases at a selected rate from a value $S_o$ at the horn throat substantially in accordance with the function $S(z)=S_o e^{mz}$. S(z) is the cross sectional area measured at any distance z from the horn throat, m is the flare constant defined as $4\pi f_c/c$, where $f_c$ is the cutoff frequency of the horn and is from about 300 Hz to about 500 Hz. The horn mouth is rectangular in shape and has a perimeter substantially equal to one wavelength of the cutoff frequency of the horn. The distance between the horn throat and the horn mouth is from about 10 inches to about 17 inches.

3 Claims, 10 Drawing Figures

EXPONENTIAL HORN SPEAKER

Field of the Invention

This invention relates to horn speakers, and more particularly to an exponential horn speaker having improved operating characteristics at low cutoff frequencies.

The Prior Art

Experience has shown that most effective horns are those whose rate of flare increases from the throat to the horn mouth. Various functions, such as hyperbolas, catenaries, and exponentials have been used in constructing such horns. The most common horn is one whose cross sectional area increases exponentially with distance from the horn throat. Several characteristics effect the operation of an exponential horn including the length, mouth size, throat size, flare rate and the cutoff frequency at which the horn is to operate.

Previously developed horn speakers such as those described and claimed in U.S. Pat. No. 2,338,262 to Salmon, entitled "Acoustic Horn", issued Jan. 4, 1944, U.S. Pat. No. 2,537,141 to Klipsch, entitled "Loud Speaker Horn", issued Jan. 9, 1951, U.S. Pat. No. 2,690,231 to Levy et al, entitled "Acoustic Device", issued Sept. 28, 1954, U.S. Pat. No. 3,930,561 to Klayman, entitled "Low Distortion Pyramidal Dispersion Speaker", issued Jan. 6, 1976 and U.S. Pat. No. 3,935,925 to Koiwa et al, entitled "Horn Unit for a Speaker", issued Feb. 3, 1976, all describe various horn configurations. However, such prior art horns have provided unsatisfactory operating characteristics at low cutoff frequencies, particularly below a frequency of 500 Hz.

A need has thus arisen for an exponential horn configuration having improved operating characteristics. Moreover, a need has arisen for an exponential horn speaker capable of operating at relatively low cutoff frequencies, particularly below a frequency of 500 Hz.

SUMMARY OF THE INVENTION

In accordance with the present invention, an exponential horn is provided which overcomes the disadvantages associated with prior art exponential horns. The exponential horn of the present invention achieves significant gain in acoustic output at relatively low cutoff frequencies, particularly below a frequency of 500 Hz.

In accordance with the present invention, an exponential horn for use in a speaker is provided and includes a mouth, a throat and horn wall sections connecting the horn mouth and the horn throat. The horn wall sections define a horn whose cross sectional area progressively increases at a selected rate from a value $S_o$ at the horn throat in accordance with the function $S(z)=S_oe^{mz}$. S(z) is the cross sectional area measured at any distance z from the horn throat. The flare constant, m, is expressed as $(4\pi f_c)/c$, where $f_c$ is the cutoff frequency of the horn and is from about 300 Hz to about 500 Hz. The horn mouth is rectangular in shape and has a perimeter substantially equal to one wavelength of the cutoff frequency of the horn. The distance between the horn throat and the horn mouth is from about 10 inches to about 17 inches.

DESCRIPTION OF THE DRAWINGS

For a more complete understanding of the present invention and for further objects and advantages thereof, reference is now made to the following detailed description taken in conjunction with the accompanying drawings, in which.

DESCRIPTION OF THE PREFERRED EMBODIMENTS

Figure 2:
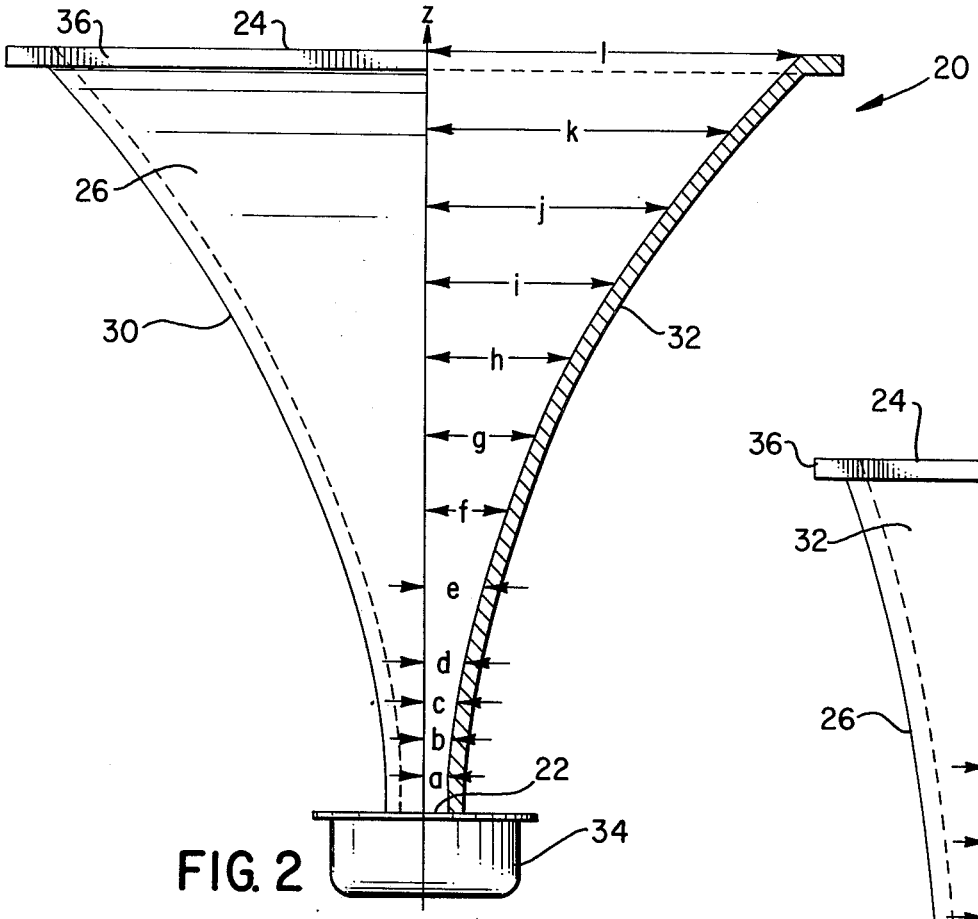
FIG. 2 is a top plan view of the exponential horn shown in FIG. 1.
Figure 1:
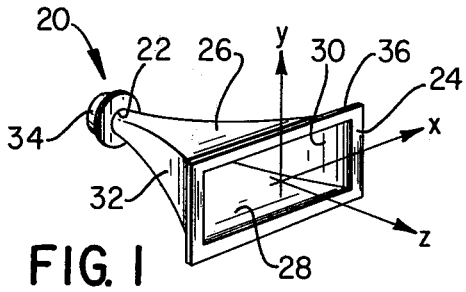
FIG. 1 is a perspective view of a first embodiment of the exponential horn of the present invention.
Figure 3:
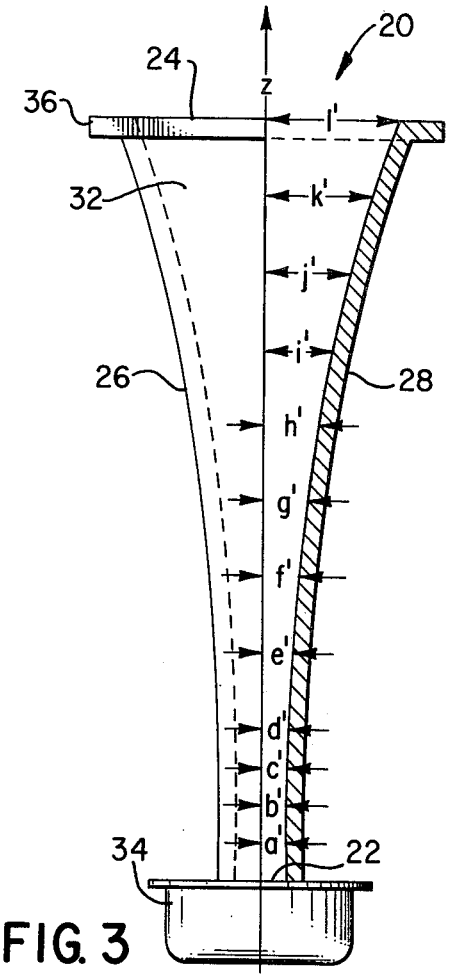
FIG. 3 is a side elevational view of the exponential horn shown in FIG. 1.
Figure 4:
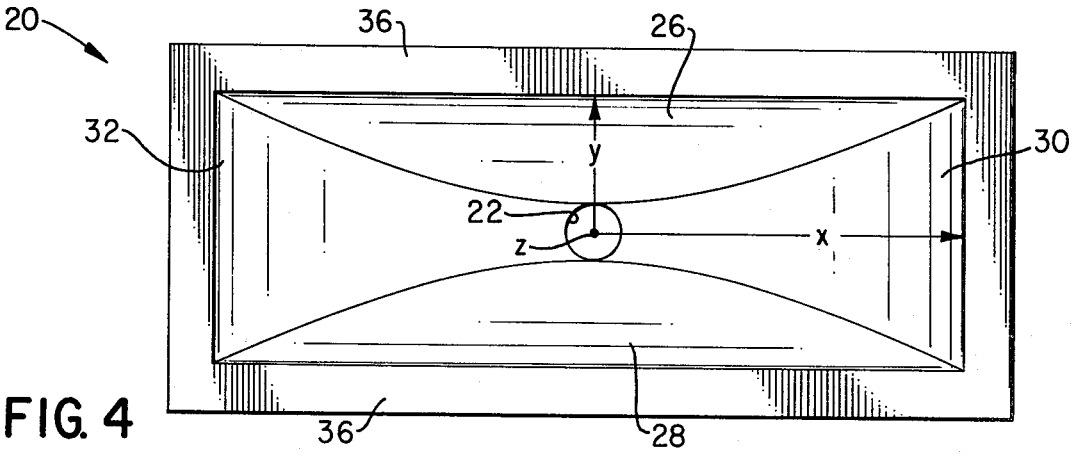
FIG. 4 is a front elevational view of the exponential horn shown in FIG. 1.

Referring simultaneously to FIGS. 1–4, a first embodiment of the exponential horn of the present invention is illustrated and is identified generally by the numeral 20. Exponential horn 20 includes a throat 22 and a mouth 24. Throat 22 and mouth 24 are interconnected by top and bottom wall sections 26 and 28 and side wall sections 30 and 32. Top and bottom wall sections 26 and 28 are inclined upwardly and downwardly, respectively, from the throat 22 to mouth 24, while side walls 30 and 32 are inclined outwardly. Although wall sections 26 and 28 have been referred to as being the top and bottom of exponential horn 20, this is for purposes of convenience in discussion. Alternatively, wall sections 30 and 32 could equally be identified as a top and bottom wall section. The configuration of wall sections 26, 28, 30 and 32 will be subsequently described. It can be seen that the cross sectional area of horn 20 from the throat 22 to the mouth 24 increases at a predetermined rate primarily determined by the elected horn cutoff frequency.

Horn 20 is connected to a conventional driver 34 through any convenient coupling. For best results, the internal diameter of horn throat 22 should be approximately equal to the diameter of the driver 34's sound throat. Horn 20 further includes a flange 36 formed integrally around the mouth 24.

Horn 20 may be constructed from materials well known to those skilled in the art; however, in the preferred embodiment horn 20 is constructed from a metal consisting of substantially an aluminum alloy No. 356 and has a wall thickness of approximately 0.25 inches. The weight of horn 20 is approximately 3.75 pounds.

For purposes of discussion, reference axes have been identified in FIGS. 1–4. A longitudinal axis, identified by the letter "z" is centrally disposed within horn 20 and lies perpendicular to planes which contain throat 22 and mouth 24. A second axis identified by the letter "x" extends perpendicular to the z axis, being horizontally disposed to perpendicularly intersect side wall sections 30 and 32 of the exponential horn 20. A third axis is identified by the letter "y" and is disposed perpendicular to the x and z axes and extends vertically to perpendicularly intersect top and bottom wall sections 26 and 28 of exponential horn 20.

Exponential horn 20 is designed in accordance with the following relation:

$$S(z)=S_0e^{mz} \quad (1)$$

where,

S(z) is the cross sectional area measured at any distance along the z axis from throat 22, $S_0$ is the cross sectional area of throat 22, m is the flare constant, and e is the base of a natural logarithm.

The flare constant, m, is given by the following relation:

$$m=(4\pi f_c)/c \quad (2)$$

where $f_c$ is the cutoff frequency, defined as the lowest frequency at which the exponential horn provides a significant gain in acoustic output, and c is the velocity of sound in air, typically 331.6 meters/second. The derivation of Equations 1 and 2 above and an analysis of the propagation of waves in horns is provided in *Elements of Acoustical Engineering* by H. F. Olson, copyright 1940, 1947 by D. Van Nostrand Co., Chapter V and *Fundamentals of Acoustics* by L. E. Kinsler and A. R. Frey, Second Edition, copyright 1950, 1962 by John Wiley & Sons, Inc. at Chapter 10. From these and other sources it is apparent that the horn mouth size, throat size and flare rate all effect the operating characteristics of exponential horns.

In the preferred embodiment, exponential horn 20 is designed to operate at a cutoff frequency, $f_c$, of approximately 483 Hz. Substituting this cutoff frequency into Equation 2 above, yields a flare constant of approximately 0.45 inches$^{-1}$. The size of mouth 24 is configured in order to provide a sound-to-air impedance match, and is determined using the desired cutoff frequency of approximately 483 cycles. In order to achieve this impedance match, the peripheral dimensions of mouth 24 are approximately equal to one wavelength of the cutoff frequency as determined using the following relation:

$$\text{wavelength}=c/f_c \quad (3)$$

where c is the velocity of sound in air, and $f_c$ is approximately 483 cycles.

Therefore, the wavelength of the cutoff frequency is approximately 27 inches. The dimensions of mouth 24 were therefore selected to be approximately 10 inches along the x axis between side wall sections 30 and 32 and approximately 3.5 inches along the y axis between top and bottom wall sections 26 and 28 of exponential horn 20.

Utilizing the above parameters together with Equations 1 and 2, the cross sectional areas S(z) and any distance z along the z axis measured from throat 22 can be calculated. In addition, the dimensions of the exponential horn 20 along the y and x axes thereof can be selected such that the calculated area at any distance z along the z axis is satisfied. In the preferred embodiment of exponential horn 20, driver 34 has a diameter of 0.707 inches, and the overall length of horn 20 from throat 22 to mouth 24 is approximately 10 inches. Utilizing these additional parameters, the data contained in Table 1 below describes the configuration of exponential horn 20.

It will be apparent from Table 1 that the distances between wall sections 26, 28, 30 and 32 do not increase but remain substantially constant in that portion of horn 20 immediately adjacent to throat 22 to form a transition region.

TABLE 1

| z Distance measured along z axis from throat (inches) | S(z) Cross sectional are of horn at distance z (square inches) | x Distance measured from z axis to side walls (inches) | y Distance measured from z axis to top and bottom walls (inches) | Reference letter used in FIG. 2 to indicate x distance | Reference letter used in FIG. 2 to indicate y distance |
|---|---|---|---|---|---|
| 0 | .39 | .35 | .35 | | |
| 0.25 | .44 | .35 | .35 | | |
| 0.50 | .49 | .35 | .35 | a | a' |
| 0.75 | .55 | .39 | .35 | | |
| 1.0 | .62 | .43 | b | b' | |
| 1.25 | .69 | .47 | .36 | | |
| 1.50 | .77 | .52 | .37 | c | c' |
| 1.75 | .86 | .56 | .38 | | |
| 2.0 | .96 | .60 | .40 | d | d' |
| 2.5 | 1.21 | .71 | .42 | | |
| 3.0 | 1.51 | .83 | .46 | e | e' |
| 3.5 | 1.89 | .97 | .49 | | |
| 4.0 | 2.37 | 1.12 | .53 | f | f' |
| 4.5 | 2.97 | 1.29 | .57 | | |
| 5.0 | 3.72 | 1.49 | .62 | g | g' |
| 5.5 | 4.65 | 1.71 | .68 | | |
| 6.0 | 5.83 | 1.95 | .74 | h | h' |
| 6.5 | 7.29 | 2.23 | .82 | | |
| 7.0 | 9.14 | 2.54 | .90 | i | i' |
| 7.5 | 11.44 | 2.89 | .99 | | |
| 8.0 | 14.32 | 3.23 | 1.11 | j | j' |
| 8.5 | 17.93 | 3.63 | 1.23 | | |
| 9.0 | 22.45 | 4.04 | 1.39 | k | k' |
| 9.5 | 28.11 | 4.50 | 1.56 | | |
| 10.0 | 35.2 | 5.03 | 1.75 | l | l' |

Figure 5:
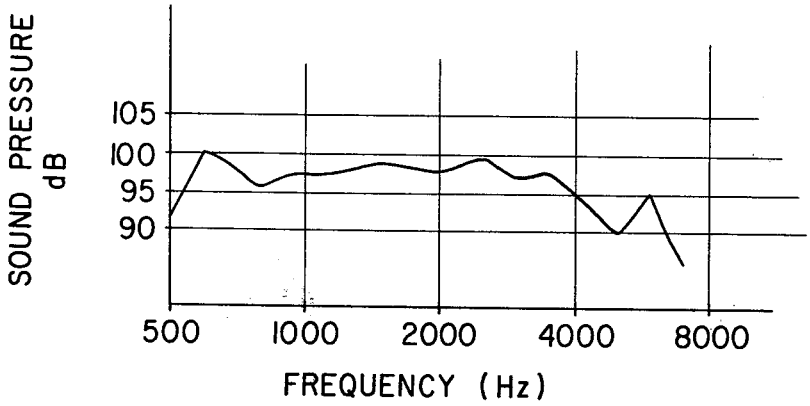
FIG. 5 is a graph of the frequency response characteristics of the first embodiment of the exponential horn of the present invention shown in FIG. 1.

FIG. 5 illustrates the frequency response of the exponential horn 20 having the configuration detailed above.

Referring simultaneously to FIGS. 6–9, a second embodiment of the exponential horn of the present invention is illustrated and is identified generally by the numeral 40. Exponential horn 40 includes a throat 42 and a mouth 44. Throat 42 and mouth 44 are interconnected by top and bottom wall sections 46 and 48 and side wall sections 50 and 52. Top and bottom wall sections 46 and 48 are inclined upwardly and downwardly, respectively from the throat 42 to mouth 44, while side walls 50 and 52 are inclined outwardly. Although wall sections 46 and 48 have been referred to as being the top and bottom of exponential horn 40, this is for purposes of convenience in discussion. Alternatively, wall sections 50 and 52 could equally be identified as a top and bottom wall section.

The configuration of wall sections 46, 48, 50 and 52 will be subsequently described. It can be seen that the cross sectional area of horn 40 from the throat 42 to the mouth 44 increases at a predetermined rate primarily determined by the elected horn cutoff frequency.

Horn 40 is connected to a conventional driver 54 through any convenient coupling. For best results, the internal diameter of horn throat 42 should be approximately equal to the diameter of the driver 54 sound throat. Horn 40 further includes a flange 56 formed integrally around the mouth 44.

Horn 40 may be constructed from materials well known to those skilled in the art; however, in the preferred embodiment horn 40 is constructed from a metal consisting of substantially an aluminum alloy No. 356 and has a wall thickness of approximately 0.25 inches. The weight of horn 40 is approximately 8 pounds.

For purposes of discussion, reference axes, x, y and z, have been identified in FIGS. 6–9 corresponding to the reference axes in FIGS. 1–4.

In the preferred embodiment, exponential horn 40 is designed to operate at a cutoff frequency, $f_c$, of approximately 310 Hz. Substituting this cutoff frequency into Equation 2 above, yields a flare constant of approximately 0.28 inches$^{-1}$. The size of mouth 44 is configured in order to provide a sound-to-air impedance match, and is determined by the desired cutoff frequency of approximately 310 cycles. The dimensions of mouth 44 were selected to be 12.7 inches along the x axis between side wall sections 50 and 52 and approximately 3.5 inches along the y axis between top and bottom wall sections 46 and 48 of exponential horn 40.

Utilizing the above parameters together with Equations 1 and 2, the cross sectional area S(z) at a distance z along the z axis measured from throat 42 can be calculated. In addition, the dimensions of the exponential horn 40 along the y and x axes thereof can be selected such that the calculated area at any distance along the z axis is satisfied. In the preferred embodiment of exponential horn 40, driver 54 has a diameter of 0.707 inches, and the overall length of horn 40 from throat 42 to mouth 44 is approximately 16.5 inches. Utilizing these additional parameters, the data contained in Table 2 below describes the configuration of exponential horn 40.

It will be apparent from Table 2 that the distance between wall sections 46 and 48 does not increase but remains substantially constant in that portion of horn 40 immediately adjacent to throat 42 to form a transition region.

TABLE 2

Figures 6, 7:
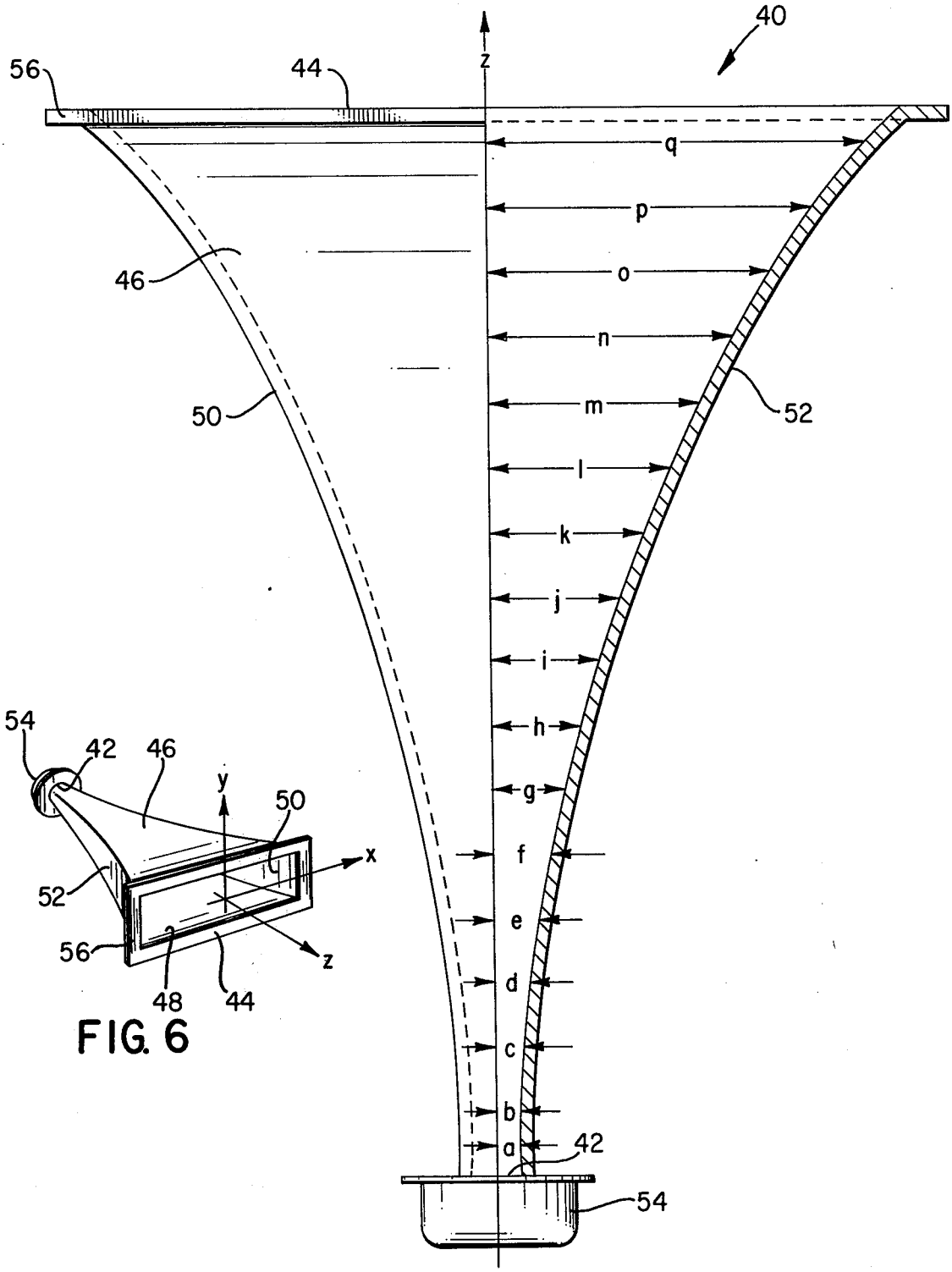
FIG. 6 is a perspective view of a second embodiment of the exponential horn of the present invention.
FIG. 7 is a top plan view of the exponential horn shown in FIG. 6.
Figure 8:
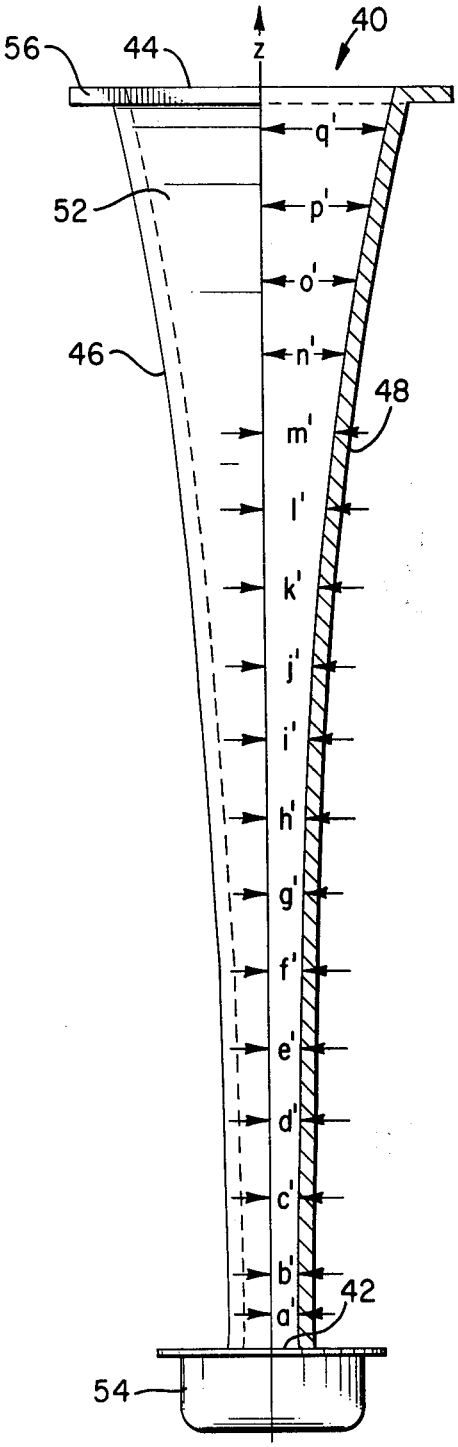
FIG. 8 is a side elevational view of the exponential horn shown in FIG. 6.
Figure 9:
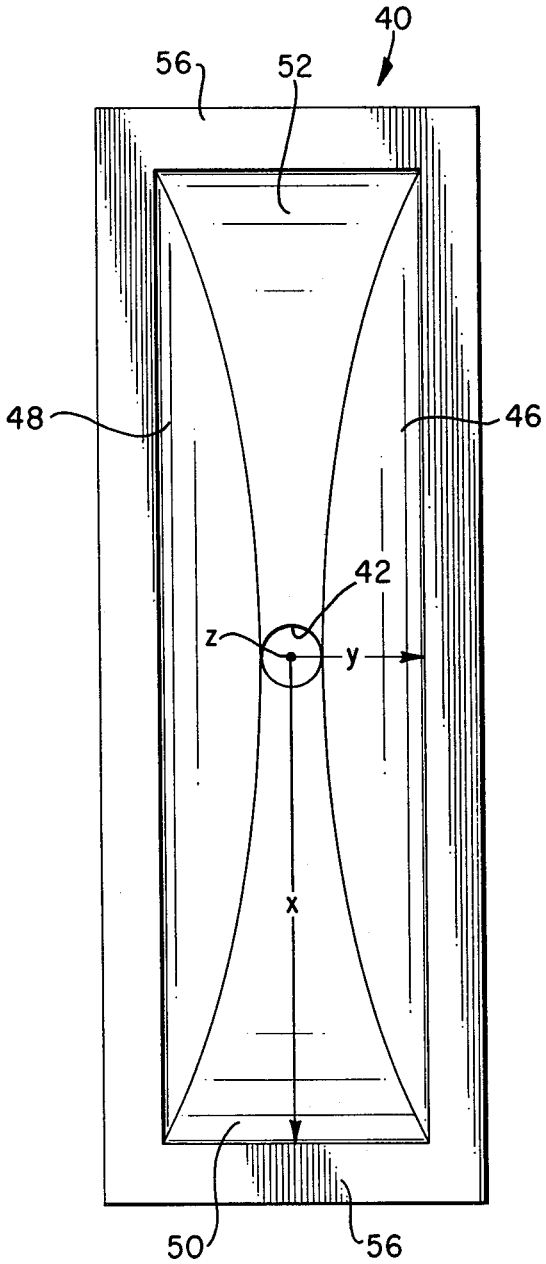
FIG. 9 is a front elevational view of the exponential horn shown in FIG. 6.

| z Distance measured along z axis from throat (inches) | S(z) Cross sectional area of horn at distance z (square inches) | x Distance measured from z axis to side walls (inches) | y Distance measured from z axis to top and bottom walls (inches) | Reference letter used in FIG. 7 to indicate x distance | Reference letter used in FIG. 8 to indicate y distance |
|---|---|---|---|---|---|
| 0 | .39 | .35 | .35 | | |
| 0.25 | .43 | .30 | .36 | | |
| 0.5 | .45 | .32 | .35 | a | a′ |
| 0.75 | .48 | .34 | .35 | | |
| 1.0 | .52 | .37 | .35 | b | b′ |
| 1.5 | .6 | .42 | .36 | | |
| 2.0 | .70 | .48 | .36 | c | c′ |
| 2.5 | .80 | .54 | .37 | | |
| 3.0 | .93 | .61 | .38 | f | d′ |
| 3.5 | 1.06 | .68 | .39 | | |
| 4.0 | 1.24 | .76 | .41 | e | e′ |
| 4.5 | 1.4 | .84 | .42 | | |
| 5.0 | 1.6 | .93 | .44 | f | f′ |
| 5.5 | 2.00 | 1.05 | .47 | | |
| 6.0 | 2.2 | 1.13 | .49 | g | g′ |
| 6.5 | 2.53 | 1.24 | .51 | | |
| 7.0 | 2.94 | 1.36 | .54 | h | h′ |
| 7.5 | 3.42 | 1.5 | .57 | | |
| 8.0 | 3.84 | 1.6 | .60 | i | i′ |
| 8.5 | 4.5 | 1.77 | .64 | | |
| 9.0 | 5.25 | 1.93 | .68 | j | j′ |
| 9.5 | 6.05 | 2.1 | .72 | | |
| 10.0 | 7.0 | 2.3 | .76 | k | k′ |
| 10.5 | 8.04 | 2.48 | .81 | | |
| 11.0 | 9.3 | 2.70 | .86 | l | l′ |
| 11.5 | 10.7 | 2.92 | .92 | | |
| 12.0 | 12.4 | 3.16 | .98 | m | m′ |
| 12.5 | 14.2 | 3.42 | 1.04 | | |
| 13.0 | 16.4 | 3.70 | 1.11 | n | n′ |
| 13.5 | 18.8 | 4.01 | 1.17 | | |
| 14.0 | 21.9 | 4.35 | 1.26 | o | o′ |
| 14.5 | 25.3 | 4.68 | 1.35 | | |
| 15.0 | 29.3 | 4.06 | 1.45 | p | p′ |
| 15.5 | 33.8 | 5.46 | 1.55 | | |
| 16.0 | 39 | 5.9 | 1.65 | q | q′ |

TABLE 2-continued

| z Distance measured along z axis from throat (inches) | S(z) Cross sectional area of horn at distance z (square inches) | x Distance measured from z axis to side walls (inches) | y Distance measured from z axis to top and bottom walls (inches) | Reference letter used in FIG. 7 to indicate x distance | Reference letter used in FIG. 8 to indicate y distance |
|---|---|---|---|---|---|
| 16.5 | 45 | 6.36 | 1.77 | | |

Figure 10:
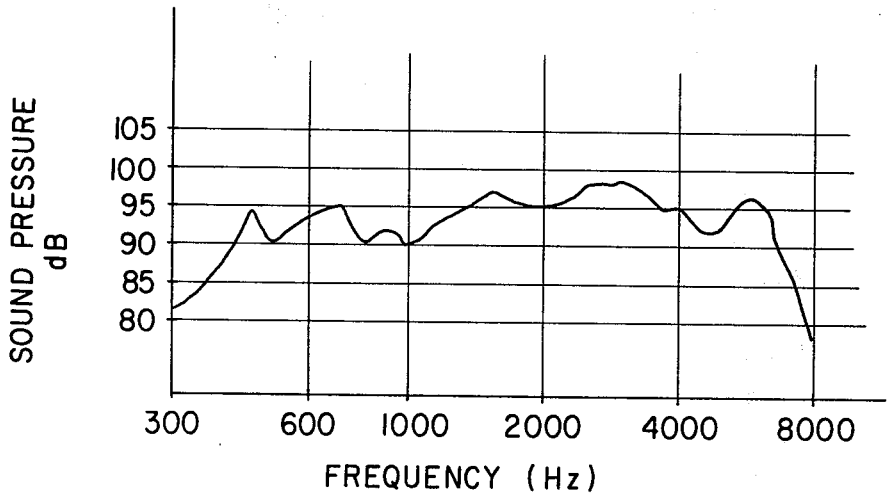
FIG. 10 is a graph of the frequency response characteristics of the second embodiment of the exponential horn of the present invention shown in FIG. 6.

FIG. 10 illustrates the frequency response of exponential horn 40 having the configuration detailed above.

Whereas the present invention has been described with respect to specific embodiments thereof, it will be evident to those skilled in the art that numerous modifications and alterations are possible without departing from the spirit and scope of the invention as set forth in the appended claims.

What is claimed is:

1. An exponential horn for use in a speaker comprising:

a hollow open ended horn having a generally rectangular cross section defined by a pair of opposed side walls and spaced apart upper and lower walls, said horn including a generally rectangular mouth and a generally circular throat at opposed ends thereof, the cross sectional area of said generally circular throat being less than the cross sectional area of said generally rectangular mouth;

said horn extending along a centrally disposed longitudinal axis defined as coordinate z, said cross sectional area of said horn progressively increasing from a value $S_o$ at said generally circular throat to said generally rectangular mouth along said longitudinal axis substantially in accordance with the function:

$$S(z)=S_o e^{mz}$$

where

S(z) is the cross sectional area measured at a distance z from said generally circular throat, along said longitudinal axis, m is the flare constant given by:

$$m=(4_{\pi}f_c)/c$$

where $f_c$ is the cutoff frequency of said horn, being from approximately 300 Hz to approximately 500 Hz, c is the velocity of sound;

said generally rectangular mouth having a perimeter substantially equal to one wavelength of said cutoff frequency, the distance between said generally circular throat and said generally rectangular mouth being from approximately 10 inches to approximately 17 inches and the cross sectional area of said generally rectangular mouth being from approximately 35 square inches to approximately 45 square inches; and said horn having a portion such that the distance between a pair of walls does not increase and remains substantially constant, said portion being disposed within a distance of approximately one inch measured along said centrally disposed longitudinal axis from said generally circular throat for forming a transition region for interfacing said generally circular throat to said rectangular cross section defined by said walls.

2. An exponential horn for use in a speaker comprising:

a hollow open ended horn having a rectangular cross section defined by a pair of opposed side walls and spaced apart upper and lower walls, said horn including a mouth and a throat at opposed ends thereof, the cross sectional area of said throat being less than the cross sectional area of said mouth;

said horn extending along a centrally disposed longitudinal axis defined as coordinate z, the cross sectional area of said horn progressively increasing from said throat to said mouth along said longitudinal axis;

said mouth having a perimeter substantially equal to one wavelength of the cutoff frequency;

said side walls being symmetrically disposed about said longitudinal axis and positioned a distance defined as coordinate x from said longitudinal axis;

said upper and lower walls being symmetrically disposed about said longitudinal axis, said upper and lower walls disposed perpendicular to said side walls and positioned a distance defined as coordinate y from said longitudinal axis;

the dimensions of said horn being defined as follows:

where z=approximately 0 inches,
x=approximately 0.35 inches, and
y=approximately 0.35 inches;
where z=approximately 0.25 inches;
x=approximately 0.35 inches, and
y=approximately 0.35 inches;
where z=approximately 0.50 inches,
x=approximately 0.35 inches, and
y=approximately 0.35 inches;
where z=approximately 0.75 inches,
x=approximately 0.39 inches, and
y=approximately 0.35 inches;
where z=approximately 1.0 inches,
x=approximately 0.43 inches, and
y=approximately 0.36 inches;
where z=approximately 1.25 inches,
x=approximately 0.47 inches, and
y=approximately 0.36 inches;
where z=approximately 1.50 inches,
x=approximately 0.52 inches, and
y=approximately 0.37 inches;
where z=approximately 1.75 inches,
x=approximately 0.56 inches, and
y=approximately 0.38 inches;
where z=approximately 2.0 inches,
x=approximately 0.60 inches, and
y=approximately 0.40 inches;
where z=approximately 2.5 inches,
x=approximately 0.71 inches, and
y=approximately 0.42 inches;
where z=approximately 3.0 inches,
x=approximately 0.83 inches, and
y=approximately 0.46 inches;
where z=approximately 3.5 inches,
x=approximately 0.97 inches, and y=approximately 0.49 inches;
where z=approximately 4.0 inches,
x=approximately 1.12 inches, and
y=approximately 0.53 inches;
where z=approximately 4.5 inches,
x=approximately 1.29 inches, and
y=approximately 0.57 inches;
where z=approximately 5.0 inches,
x=approximately 1.49 inches, and
y=approximately 0.62 inches;
where z=approximately 5.5 inches,
x=approximately 1.71 inches, and
y=approximately 0.68 inches;
where z=approximately 6.0 inches,
x=approximately 1.95 inches, and
y=approximately 0.74 inches;
where z=approximately 6.5 inches,
x=approximately 2.23 inches, and
y=approximately 0.82 inches;
where z=approximately 7.0 inches,
x=approximately 2.54 inches, and
y=approximately 0.90 inches;
where z=approximately 7.5 inches,
x=approximately 2.89 inches, and
y=approximately 0.99 inches;
where z=approximately 8.0 inches,
x=approximately 3.23 inches, and
y=approximately 1.11 inches;
where z=approximately 8.5 inches,
x=approximately 3.63 inches, and
y=approximately 1.23 inches;
where z=approxoimately 9.0 inches,
x=approximately 4.04 inches, and
y=approximately 1.39 inches;
where z=approximately 9.5 inches,
x=approximately 4.50 inches, and
y=approximately 1.56 inches;
where z=approximately 10.0 inches,
x=approximately 5.03 inches, and
y=approximately 1.75 inches.

3. An exponential horn for use in a speaker comprising:

a hollow open ended horn having a rectangular cross section defined by a pair of opposed side walls and spaced apart upper and lower walls, said horn including a mouth, and a throat at opposed ends thereof, the cross sectional area of said throat being less than the cross sectional area of said mouth;

said horn extending along a centrally disposed longitudinal axis defined as coordinate z, the cross sectional area of said horn progressively increasing from said throat to said mouth along said longitudinal axis;

said mouth having a perimeter substantially equal to one wavelength of the cutoff frequency;

said side walls being symmetrically disposed about said longitudinal axis and positioned a distance defined as coordinate x from said longitudinal axis;

said upper and lower walls being symmetricaly disposed about said longitudinal axis, said upper and lower walls disposed perpendicular to said side walls and positioned a distance defined as coordinate y from said longitudinal axis;

the dimensions of said horn being defined as follows:

where z=approximately 0 inches,
x=approximately 0.35 inches, and
y=approximately 0.35 inches;
where z=approximately 0.25 inches,
x=approximately 0.30 inches, and
y=approximately 0.36 inches;
where z=approximately 0.5 inches,
x=approximately 0.32 inches, and
y=approximately 0.35 inches;
where z=approximately 0.75 inches,
x=approximately 0.34 inches, and
y=approximately 0.35 inches;
where z=approximately 1.0 inches,
x=approximately 0.37 inches, and
y=approximately 0.35 inches;
where z=approximately 1.5 inches,
x=approximately 0.42 inches, and
y=approximately 0.36 inches;
where z=approximately 2.0 inches,
x=approximately 0.48 inches, and
y=approximately 0.36 inches;
where z=approximately 2.5 inches,
x=approximately 0.54 inches, and
y=approximately 0.37 inches;
where z=approximately 3.0 inches,
x=approximately 0.61 inches, and
y=approximately 0.38 inches;
where z=approximately 3.5 inches,
x=approximately 0.68 inches, and
y=approximately 0.39 inches;
where z=approximately 4.0 inches,
x=approximately 0.76 inches, and
y=approximately 0.41 inches;
where z=approximately 4.5 inches,
x=approximately 0.84 inches, and
y=approximately 0.42 inches;
where z=approximately 5.0 inches,
x=approximately 0.93 inches, and
y=approximately 0.44 inches;
where z=approximately 5.5 inches,
x=approximately 1.05 inches, and
y=approximately 0.47 inches;
where z=approximately 6.0 inches,
x=approximately 1.13 inches, and
y=approximately 0.49 inches;
where z=approximately 6.5 inches,
x=approximately 1.24 inches, and
y=approximately 0.51 inches;
where z=approximately 7.0 inches,
x=approximately 1.36 inches, and
y=approximately 0.54 inches;
where z=approximately 7.5 inches,
x=approximately 1.5 inches, and
y=approximately 0.57 inches;
where z=approximately 8.0 inches,
x=approximately 1.6 inches, and
y=approximately 0.60 inches;
where z=approximately 8.5 inches,
x=approximately 1.77 inches, and
y=approximately 0.64 inches;
where z=approximately 9.0 inches,
x=approximately 1.93 inches, and
y=approximately 0.68 inches;
where z=approximately 9.5 inches,
x=approximately 2.1 inches, and
y=approximately 0.72 inches;
where z=approximately 10.0 inches,
x=approximately 2.3 inches, and
y=approximately 0.76 inches;
where z=approximately 10.5 inches,
x=approximately 2.48 inches, and
y=approximately 0.81 inches;

where z=approximately 11.0 inches,
x=approximately 2.70 inches, and
y=approximately 0.86 inches;
where z=approximately 11.5 inches,
x=approximately 2.92 inches, and
y=approximately 0.92 inches;
where z=approximately 12.0 inches,
x=approximately 3.16 inches, and
y=approximately 0.98 inches;
where z=approximately 12.5 inches,
x=approximately 3.42 inches, and
y=approximately 1.04 inches;
where z=approximately 13.0 inches,
x=approximately 3.70 inches, and
y=approximately 1.11 inches;
where z=approximately 13.5 inches,
x=approximately 4.01 inches, and
y=approximately 1.17 inches;
where z=approximately 14.0 inches,
x=approximately 4.35 inches, and
y=approximately 1.26 inches;
where z=approximately 14.5 inches,
x=approximately 4.68 inches, and
y=approximately 1.35 inches;
where z=approximately 15.0 inches,
x=approximately 5.06 inches, and
y=approximately 1.45 inches;
where z=approximately 15.5 inches,
x=approximately 5.46 inches, and
y=approximately 1.55 inches;
where z=approximately 16.0 inches,
x=approximately 5.9 inches, and
y=approximately 1.65 inches;
where z=approximately 16.5 inches,
x=approximately 6.36 inches, and
y=approximately 1.77 inches.

* * * * *